US009394929B2

(12) United States Patent
Lawrence et al.

(10) Patent No.: US 9,394,929 B2
(45) Date of Patent: Jul. 19, 2016

(54) REDUCING DIG FORCE IN HYDRAULIC IMPLEMENTS

(71) Applicant: Caterpillar Inc., Peoria, IL (US)

(72) Inventors: Keith Edward Lawrence, Peoria, IL (US); John James Krone, Peoria, IL (US); Nick William Biggs, Princeville, IL (US); Karl Arthur Kirsch, Chillicothe, IL (US); Yuya Kanenawa, Hyogo-ken (JP); Tetsuya Yoshino, Hyogo-ken (JP); Magomed Gabibulayev, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 440 days.

(21) Appl. No.: 13/957,052

(22) Filed: Aug. 1, 2013

(65) Prior Publication Data

US 2015/0033719 A1 Feb. 5, 2015

(51) Int. Cl.

| | |
|---|---|
| ***F15B 11/10*** | (2006.01) |
| ***F15B 21/04*** | (2006.01) |
| ***E02F 3/43*** | (2006.01) |
| ***E02F 9/22*** | (2006.01) |

(52) U.S. Cl.

CPC ..... *F15B 21/047* (2013.01); *E02F 3/435* (2013.01); *E02F 9/2207* (2013.01); (Continued)

(58) Field of Classification Search

CPC ..... F15B 11/10; F15B 13/042; F15B 21/047; F15B 2211/31535; F15B 2211/31558; F15B 2211/329; F15B 2211/41581; F15B 2211/50518; F15B 2211/5159; F15B 2211/575; F15B 2211/20546; F15B 2211/30505; F15B 2211/30565; F15B 2211/40507; F15B 2211/505; F15B 2211/6346; F15B 2211/6355; F15B 2211/88; E02F 3/435; E02F 3/2207; E02F 9/2207; E02F 9/2292; E02F 9/2296; E02F 9/2285

USPC ..... 60/421, 430, 428

See application file for complete search history.

(56) References Cited

U.S. PATENT DOCUMENTS

| | | | | |
|---|---|---|---|---|
| 4,923,362 | A | 5/1990 | Fryk | |
| 6,266,960 | B1 | 7/2001 | Bibb et al. | |
| 2009/0129951 | A1 * | 5/2009 | Hyde | F04B 23/06 417/322 |

(Continued)

FOREIGN PATENT DOCUMENTS

| | | | |
|---|---|---|---|
| EP | 0856612 | A1 | 8/1998 |
| EP | 1416096 | A1 | 10/2003 |
| JP | 02212603 | A * | 8/1990 |

*Primary Examiner* — Nathaniel Wiehe
*Assistant Examiner* — Logan Kraft
(74) *Attorney, Agent, or Firm* — Miller, Matthias & Hull LLP

(57) ABSTRACT

In order to avoid cavitation in a boom cylinder head end at the beginning of a dig cycle, fluid from an alternate source is supplied to the head end before or in addition to fluid supplied by the main boom-up hydraulic circuit. In one embodiment, an electronic hydraulic valve, related sensors, and control system determines the beginning of a dig operation and uses fluid at an intermediate pressure to rapidly provide fluid to a boom head end cylinder to prevent voiding or cavitation before fluid under high pressure from the main pump can be brought to the cylinder. An on/off fluid switch is activated early in a dig operation to address low pressure at the boom cylinder head end and provide an alternate path for fluid into the cylinder in reaction to the boom being lifted by a motion of the stick and bucket in contact with the work surface.

19 Claims, 8 Drawing Sheets

(52) U.S. Cl.
CPC ..... *E02F 9/2285* (2013.01); *E02F 9/2292* (2013.01); *E02F 9/2296* (2013.01); *F15B 2211/20546* (2013.01); *F15B 2211/30505* (2013.01); *F15B 2211/30565* (2013.01); *F15B 2211/31558* (2013.01); *F15B 2211/329* (2013.01); *F15B 2211/40507* (2013.01); *F15B 2211/41581* (2013.01); *F15B 2211/50518* (2013.01); *F15B 2211/5159* (2013.01); *F15B 2211/575* (2013.01); *F15B 2211/6346* (2013.01); *F15B 2211/6355* (2013.01); *F15B 2211/88* (2013.01)

(56) References Cited

U.S. PATENT DOCUMENTS

| | | | | |
|---|---|---|---|---|
| 2012/0152575 | A1 | 6/2012 | Hand et al. | |
| 2013/0129460 | A1 | 5/2013 | Gabibulayev | |
| 2014/0283508 | A1* | 9/2014 | Hiraku | F15B 7/006 60/328 |
| 2015/0247305 | A1* | 9/2015 | Imura | E02F 9/2095 60/413 |

* cited by examiner

REDUCING DIG FORCE IN HYDRAULIC IMPLEMENTS

RELATED APPLICATION

The present application is a continuation-in-part of and claims priority to U.S. patent application Ser. No. 13/721,719 entitled, "Hydraulic System For Controlling a Work Implement," which is hereby incorporated by reference for all purposes.

TECHNICAL FIELD

The present disclosure relates to hydraulic implements and more particularly to improving performance and fuel economy in machines with boom, stick and bucket linkages which include excavators and backhoe loaders.

BACKGROUND

When operating hydraulic equipment conditions may arise when a sudden change in configuration causes voiding in hydraulic boom cylinders. For example, when an excavating bucket contacts the ground at the beginning of a dig, a reaction force against the bucket including support for the weight of the implement, may be transmitted through the stick and cause the boom to be pushed up faster than the boom cylinder can respond. This upward force can draw the rod and piston from the boom cylinder and cause a low pressure situation at the head end of the boom cylinders.

EP1416096A1 discloses a system that monitors for a number of conditions including low boom cylinder head end pressure to draw oil from the return line to the boom cylinder head end. The '096 reference fails to disclose a hydraulic circuit, components, and control system that meters fluid to a boom cylinder head end based on a defined point in the dig operation to reduce or eliminate voiding in the boom cylinder.

SUMMARY

According to one aspect of the disclosure, a method of providing fluid to a cylinder in an implement when the cylinder experiences low pressure includes delivering fluid to a head end of the cylinder from both a first fluid source and a second fluid source, the first fluid source providing fluid at a first pressure higher than a second pressure from the second fluid source. The method may also include identifying a condition that occurs while delivering fluid to the head end of the cylinder from both the first and second fluid sources and responsive to identifying the condition, sending a signal to a valve causing the second fluid source to be disconnected from the head end of the cylinder.

According to another aspect of the disclosure, a method of reducing voiding in a head end of a cylinder of a boom of an excavator may include connecting the head end of the cylinder to a first fluid source at a first pressure to initiate a transfer of fluid from the first fluid source to the head end of the cylinder, determining that a dig operation is underway, and responsive to determining that the dig operation is underway, connecting the head end of the cylinder to a second fluid source at a second pressure to initiate a transfer of fluid from the second fluid source to the head end of the cylinder. The second pressure is lower than the first pressure. After connecting the head end of the cylinder to the second fluid source, identifying a condition and disconnecting the second fluid source from the head end of the cylinder responsive to identifying the condition.

In yet another aspect of the disclosure, an apparatus for providing fluid to a cylinder in an implement may include a first fluid source that provides fluid at a high pressure, the cylinder having a head end, the head end controllably coupled to the first fluid source via a spool valve, a head end pressure sensor and a control stick position sensor. The a second fluid source has a lower pressure than the first fluid source. The apparatus may also include a control valve that operates responsive to an electrical signal to selectively connect the second fluid source to the head end, and a controller coupled to the head end pressure sensor, the control stick position sensor, and the control valve, wherein the controller generates the electrical signal to close the control valve to disconnect the second fluid source responsive to identification of a condition.

These and other benefits will become apparent from the specification, the drawings and the claims.

DESCRIPTION

Figure 1:
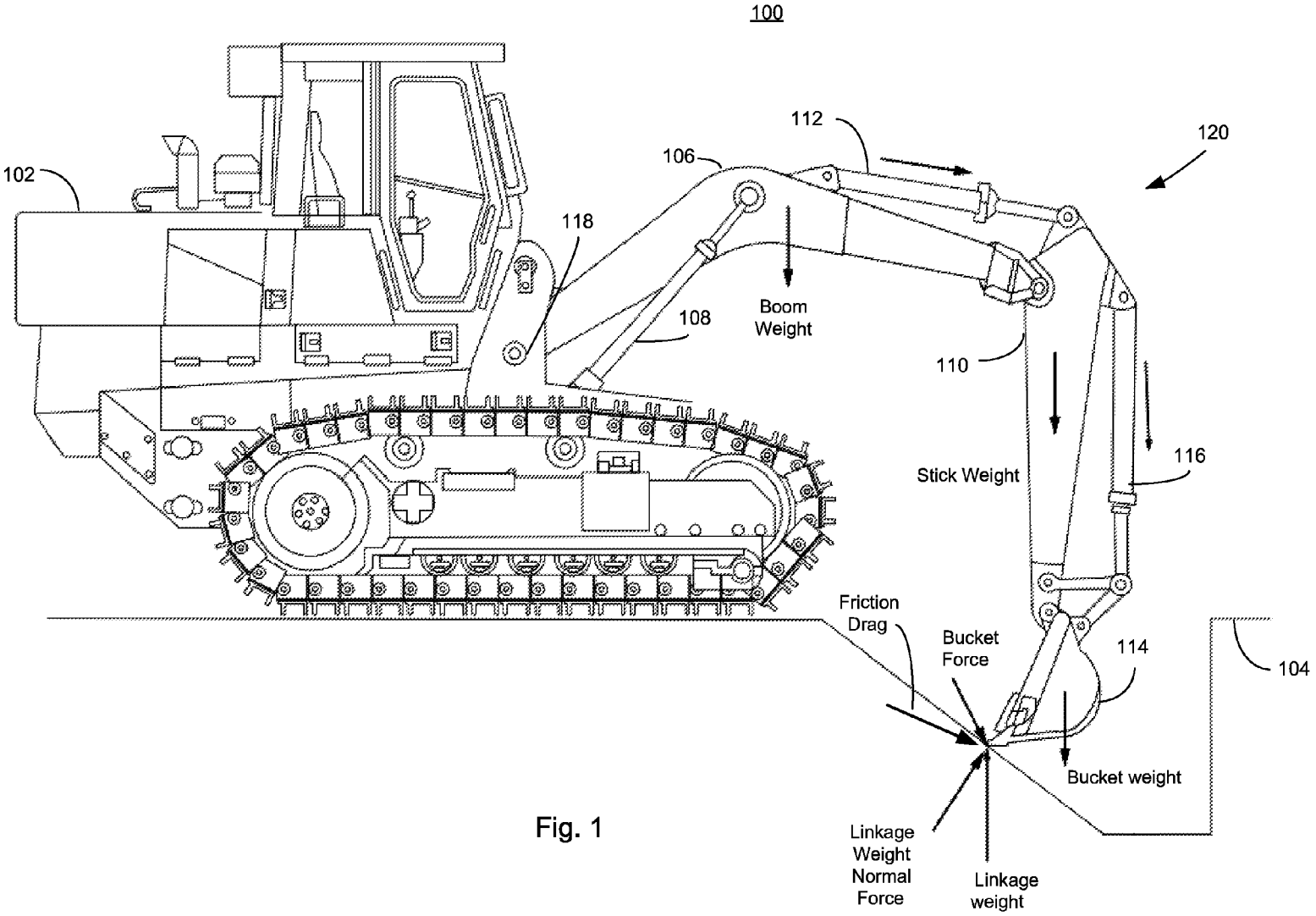
FIG. 1 is a view of an implement at a work site.

FIG. 1 illustrates an exemplary excavator 102 at a work site 100. While an excavator is discussed and described, the techniques and apparatus disclosed below are applicable to and can be implemented with any application or configuration which utilizes a boom, stick and work implement and/or any number of other boom/stick/bucket machines, including, but not limited to, shovels and backhoes, and may include machines that may have a single or multiple cylinders operating the boom. The excavator 102 is shown with its bucket in contact with a work surface 104. The excavator 102 is shown in this simplified drawing with an implement 120 having a boom 106 and a boom cylinder 108 that raises and lowers the boom 106. The implement 120 also has a stick 110 and its corresponding stick cylinder 112 as well as work implement, shown and hereinafter referred to as bucket 114 for the purposes of illustration, and a bucket cylinder 116.

The various arrows illustrate gravity, cylinder forces, and reaction forces which may be present during a dig operation of the implement 120. The weight of implement 120, including, but not limited to, the boom 106, the stick 110, and the bucket 114 (and their associated cylinders, hydraulic lines, pivots, etc.) can be supported at a boom pivot 118, by the boom cylinders 108, and by the work surface 104 at the contact point with the bucket. Ideally, at least at the beginning of the dig operation most of the weight of the implement 120 can be borne by the boom cylinders 108 so that the ground engaging elements (not depicted) of the bucket 114 can enter the work surface 104 cleanly with minimal fiction force.

However, as the dig operation progresses and the bucket 114 is inserted into and drawn through the work surface 104, by curling the bucket 114, by drawing the stick 110 inwardly towards the boom 106 and boom pivot 118, or both, there can be an upward reaction force that lifts the bucket 114 and stick 110 up, causing, in the view shown in FIG. 1, the boom 106 to rotate counterclockwise about the boom pivot 118.

This rotation or lifting can cause the boom cylinder rods (e.g., 160 of FIG. 2) to be forcibly drawn out of the boom cylinder 108. As will be discussed more below, this action of the boom cylinder rods 160 can cause a temporary void 166 of the fluid in the head end of the boom cylinders 108. While this condition exists, the temporary void 166 or disparity can result in an insufficient amount of pressurized fluid within the head end 152 of the boom cylinders 108 available such that the boom cylinders are temporarily no longer able to provide lift and/or support the weight of the implement 120. As a result, at least a portion of the unsupported implement weight can be transferred to the bucket/work-surface interface, and can substantially increase the frictional or drag force opposing the movement of the bucket 114 into and through the work surface 104. An operator generally issues a boom up command while digging but the response of the system may not be fast enough to power the boom cylinders in this short-lived initial state, generally no longer than 2-3 seconds, which may at least be partially due to the lack of on-demand pressurized fluid in order to make up for the temporary void 166. Studies have shown that this additional frictional force during that 2-3 second interval can cause a significant increase in fuel consumption in the overall operation of the excavator 102.

Figure 2:
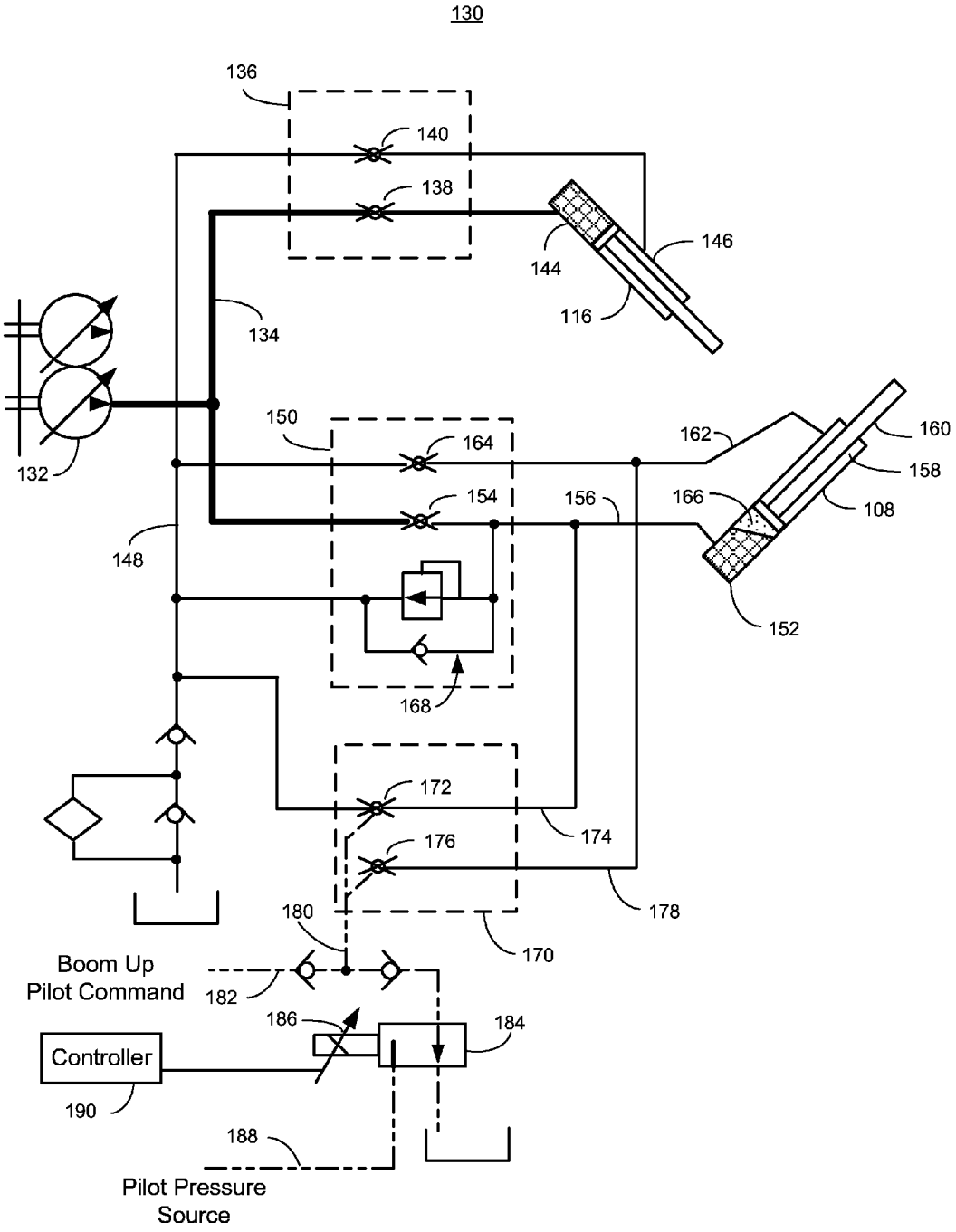
FIG. 2 is a block diagram of an electrohydraulic circuit for use in the excavator of FIG. 1.

Existing boom cylinder head-end check valves, e.g., check valve 168 of FIG. 2, may be installed to provide supplemental fluid to the boom cylinders, but these are generally too small to provide a meaningful response in a timely manner. Further, because these check valve 168 is connected to the rod end cylinder-to-tank line 162, the pressure supplying the fluid may be inconsistent or too low to overcome the small size of the check valve 168 with a sufficient volume of fluid To address this situation, a controller and/or specialized hydraulic circuit (not depicted in FIG. 1) may be used in the excavator 102 to rapidly respond to the conditions associated with cavitation in the head end of the boom cylinder 108 and prevent the undue frictional forces at the beginning of a dig, resulting in an overall fuel savings of 5% or more in some machines.

FIG. 2 is a block diagram of an electrohydraulic circuit 130 for use in the excavator of FIG. 1. The circuit 130 includes one or more main hydraulic pumps 132.

In a conventional manner, the pump 132 may supply high pressure fluid via a fluid line 134 to a stick spool valve 136 with individual valves 138 and 140 that connect, respectively, the pump 132 to the head end 144 of the stick cylinder 112 and the rod end 146 to the tank line 148.

The pump 132 may also be connected to a head end 152 of the boom cylinder 108 via a first boom cylinder spool 150 using valve 154 and line 156. The rod end 158 of the boom cylinder 108 may be connected to the tank line 148 via line 162 and valve 164. A check valve 168 may operate in a conventional manner to allow fluid flow between the tank line 148 and the boom cylinder line 156. As discussed above, these check valves are generally either too small to be effective during the transient of the initial dig operation or cause feel and handling problems if increased in size.

As illustrated, when the rod 160 is drawn out of the boom cylinder 108 during the beginning of a dig operation, the supply of fluid in the head end 152 of the boom cylinder 108 cannot be replenished quickly enough via valve 154 and a void area 166 may be created. As discussed above, this void 166 may exist for several seconds, during which time the boom cylinder 108 provides virtually no lift to support the implement 120.

In the embodiment of FIG. 2, the void 166 may be eliminated using a secondary boom cylinder spool 170 to provide fluid to the head end 152 of the boom cylinder. As shown, valve 172 may connect the tank line 148 to the boom cylinder line 156 via line 174. The valve 176 that would typically connect to line 178 and the rod end line 162 to the pump 132 is not connected.

When a boom up pilot command is received via line 182, that is, a control signal used to open the secondary boom cylinder spool 170 via line 180, and a determination may be made that a dig operation is underway the controller 190 issues a command to electrohydraulic valve 184 via control 186 to connect pilot pressure source 188 to the valve control line 180 and override the boom up pilot command. During this override period, the valve 172 connects the tank line 148 to the head end 152 of the boom cylinder 158 as illustrated. This provides a temporary, high-volume flow path for fluid under pressure from the rod end 158 back into the head end 152. While the pressure supplied from the tank line 148 may be insufficient to actually lift the implement 120, enough pressure is provided to significantly reduce the implement weight causing frictional force at the bucket 114. After certain conditions are reached the controller 190 may turn off the valve 184 and allow the normal pilot command signal via line 182 to again control the secondary boom cylinder spool 170.

Figure 3:
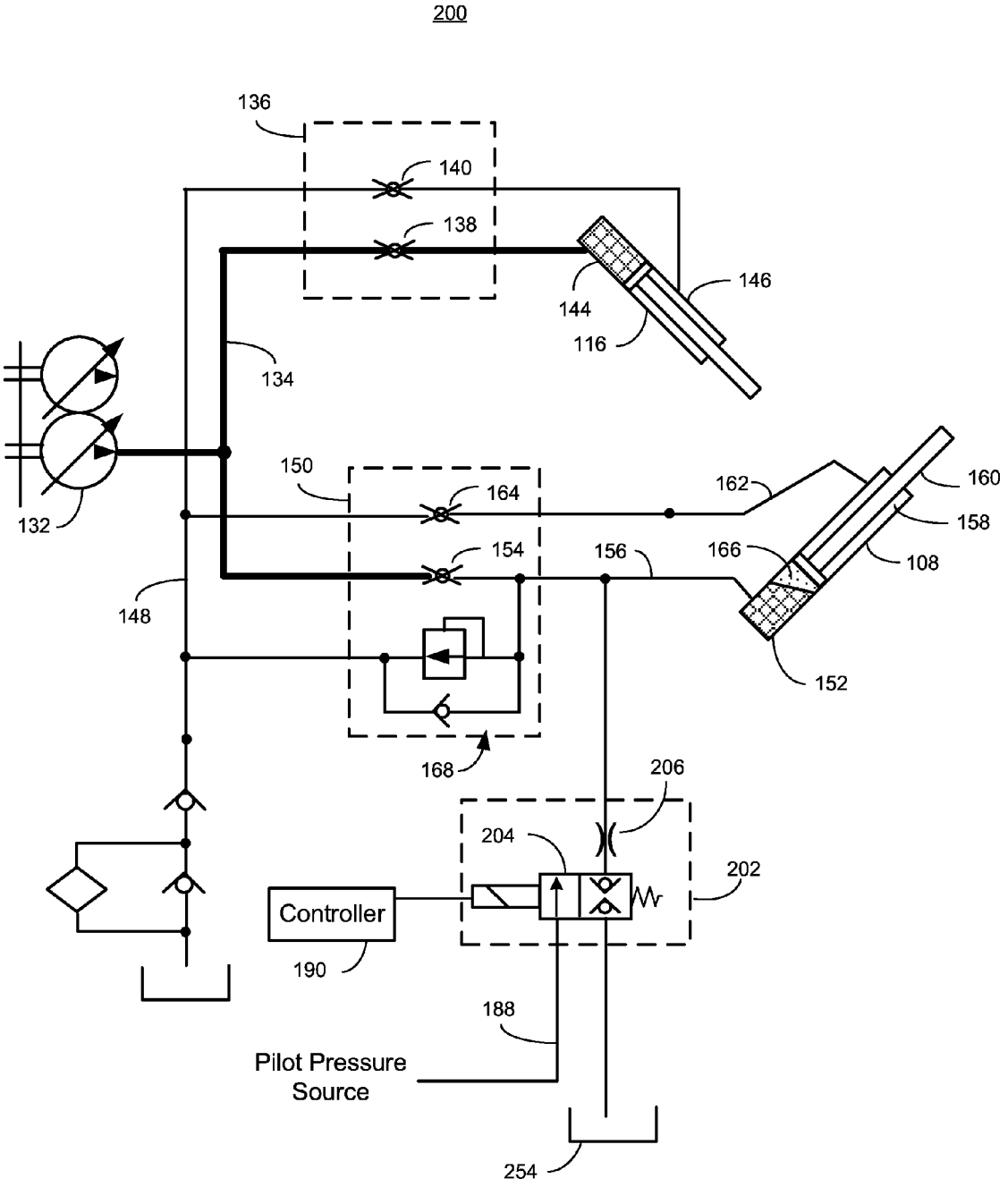
FIG. 3 is a block diagram of another electrohydraulic circuit for use in the implement of FIG. 1.

FIG. 3 is a block diagram of another electrohydraulic circuit 200 for use in the excavator of FIG. 1. FIG. 3 repeats a substantial portion of the elements of FIG. 2 with respect to the stick cylinder 112, stick spool valve 136, pump 132, boom cylinder 108, and boom cylinder spool valve 150. In this illustrated embodiment, the void 166 may be eliminated using a hydraulic circuit 202 with an electrohydraulic valve 204 under the control of the controller 190. In this embodiment, the controller 190 may evaluate a number of conditions to conclude that a dig operation has begun and turn on the electrohydraulic valve 204 to couple a source of pilot pressure source 188 to the head end 152 of the boom cylinder 108. These conditions are discussed in more detail below.

The controller 190 or an engine control module (ECM) managing that function will signal the electrohydraulic valve 204 to close after certain other conditions have been identified, which are also discussed in more detail below. An orifice 206 restricts flow to help ensure that the pilot pressure source 188 is not reduced below a working level while the fluid is injected into the boom cylinder head in 152. In this embodiment, using the pilot pressure source 188 as the source of pressurized fluid provides a more uniform pressure compared to the rod end cylinder to tank line 148. Additionally, because the pilot pressure source is generally well below that of the main pump 132 and also well below that required to physically lift the boom 106, the goal of reducing or preventing cavitation is met without introducing so much pressure that the boom 106 may be moved unintentionally. As long as the boom cylinder can support some portion of the implement weight, a significant reduction in friction force at the bucket may be realized.

Figure 4:
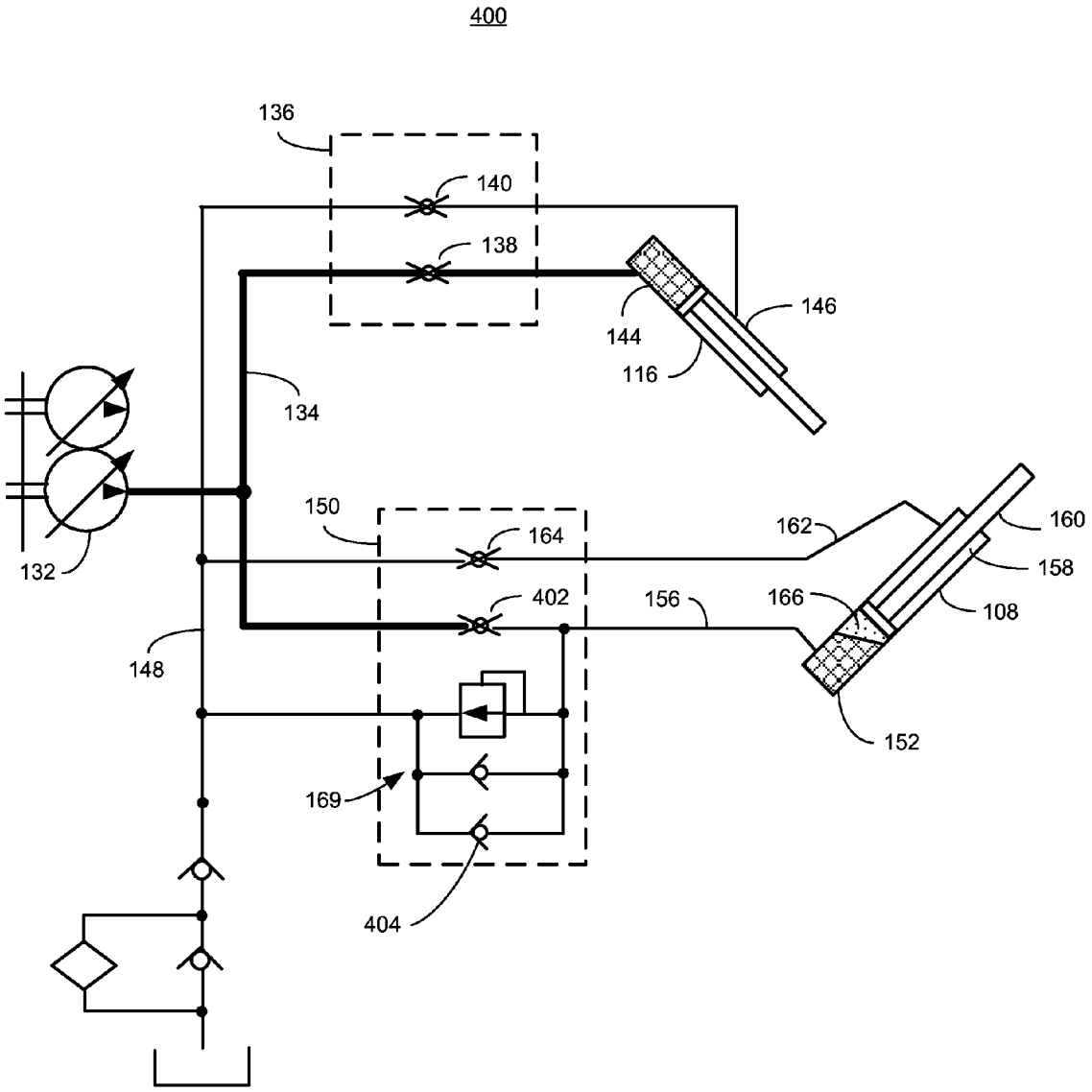
FIG. 4 is a block diagram of a hydraulic circuit for use in the implement of FIG. 1.

FIG. 4 is a block diagram 400 of a hydraulic circuit for use in the implement of FIG. 1. Unlike the electrohydraulic circuits of FIGS. 2 and 3, the hydraulic circuit of FIG. 4 does not use an electrically-controlled valve to supply fluid to the cylinder head end during the initial dig operation to eliminate the void 166.

As discussed above, an operator, or an autonomous function, may desire to dig earth or other material at work site 100 with the depicted excavator 102, and then dump the material into a haul truck (not shown) or other holding vehicle. As the work implement control system 108 responds to dig commands, for example, "stick in" and "bucket close," the stick cylinder 112 may extend so that the stick 110 is urged in toward the cab, and the bucket cylinder 116 may extend so that the bucket 114 may begin to close, moving downwards and curling inward towards the stick 110 and cab, digging material and then holding it as is well known by ordinary persons skilled in the art. While the bucket 114 is digging, interaction between the bucket 114 and the material 104 the bucket 114 is digging may cause a resistive load to be applied to the bucket 114. This resistive load may create a moment on the implement 120, which may cause an extension of the boom cylinder 108 even though the operator is not inputting a "boom up" command. This unintended extension of the boom cylinder 108 may create a void 166 in the boom cylinder 108 as well as increase pressure at a rod-end 158 of the boom cylinder 108.

The combination line relief with check or a reconfigured makeup valve 169 and, in some embodiments, a second makeup valve 404, may be configured to provide additional fluid flow to the head end 152 of the boom cylinder 108 to fill the void. Thus, the boom cylinder 108 is filled with fluid before a subsequent "boom up" command by the operator and the boom cylinder 108 can move in response to the "boom up" command without delay. Further, even though the fluid supplied via the makeup valve(s) 169 and 404 do not provide sufficient pressure to actually lift the implement 120, the fluid does have sufficient pressure to help support the implement 120 thereby reducing the friction force caused at the bucket 114-work surface 104 interface by reducing the normal force at the point of contact.

Because a boom up command at the beginning of the dig cycle connects high pressure line 134 to the low, potentially zero, pressure of the boom cylinder via the control valve 402, there is a potential to drop the pressure in the fluid line 134 enough to affect performance in other areas of the implement 120 or excavator 102 in general. To address this, the spool valve may be modified to limit the flow of fluid over an initial range of operation by the operator.

Figure 8:
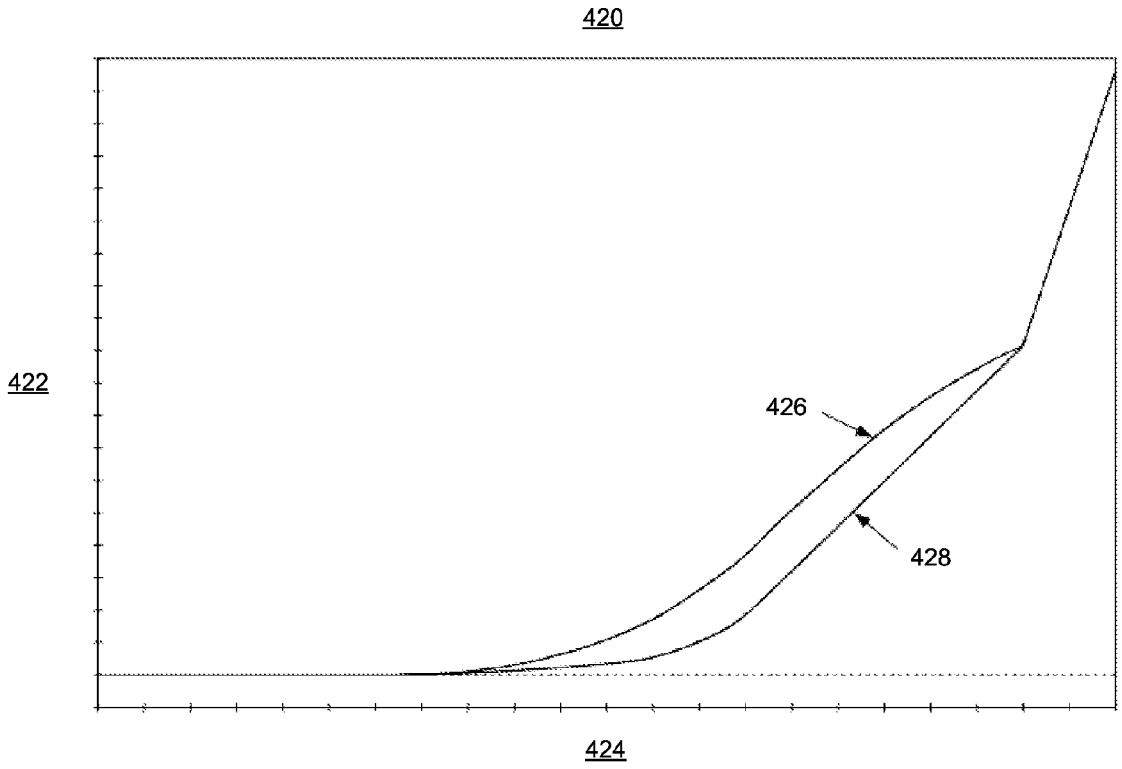
FIG. 8 is a graph of spool valve displacement vs. spool valve opening for nominal and modified valves.

Referring briefly to FIG. 8, a graph 420 illustrates an exemplary opening area versus spool displacement for the valve opening of the metering control valve 150 in a rod extension position. Although units are not illustrated in FIG. 8, the x-axis 424 of the graph 420 may represent spool displacement in mm, while the y-axis 422 of the graph 420 may represent the valve opening area in $mm^2$. The graph 420 includes a first curve 426 showing a conventional opening versus displacement for a metering control valve and a second curve 428 showing an exemplary opening versus displacement for metering control valve 402 in accordance with the disclosure.

The area of the valve opening varies as the spool valve 402 is displaced in the metering control valve 150. In one embodiment of the illustrated exemplary graph 420, the area of the valve opening may vary from 0 $mm^2$ at 0 mm spool displacement (i.e., closed) to a maximum valve opening area of about 185 $mm^2$ at 11 mm spool displacement (i.e., maximum spool displacement). One embodiment of the second curve 428 may represent a reduced initial opening area up to about 10 mm spool displacement. For example, over about the first 5.5 mm spool displacement (or about 50% of total spool displacement), the valve opening area may be less than 5 $mm^2$ or less than 3% of maximum valve opening area). Over about the first 6.5 mm of spool displacement, the valve opening area may be less than about 10 $mm^2$ (or less than 5.5% of maximum valve opening area), which is about one-half the area of the valve opening of the conventional valve at 6.5 mm displacement, as represented by curve 426.

Figure 5:
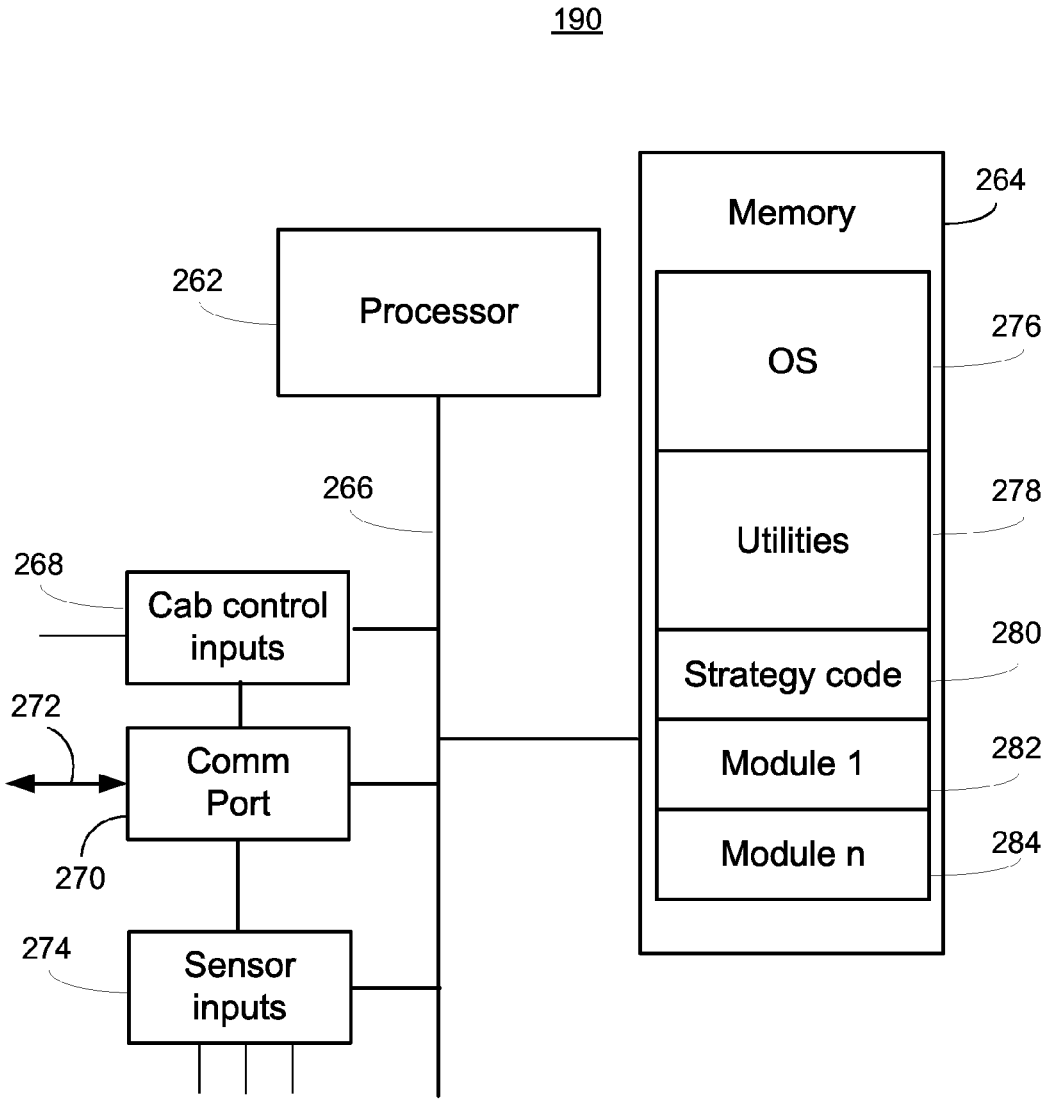
FIG. 5 is a block diagram of a controller suitable for use with the electrohydraulic circuits of FIG. 2 and FIG. 3.

FIG. 5 is a block diagram of a controller 190 suitable for use with the electrohydraulic circuits of FIG. 2 and FIG. 3. The controller 190 may be a standalone unit or may be part of another electronic control module of the excavator 102. The controller 190 may include a processor 262 that is coupled to a memory 264 by a data bus 266. The data bus 266 may also provide connectivity to input controls 268, a communication port 270 that supports communication with an external bus 272, and sensor inputs 274. The sensor inputs 274 may collect data from a variety of sensors such as pressure sensors at the pump 132, head end 152 and rod end 158 of the boom cylinder 108, the tank line 148, and the pilot pressure source 188. The input controls may also include control stick positions or control pressure values so that the controller 190 can determine operator actions with respect to the implement 120.

The memory 264 may include modules such as an operating system 276, utilities 278 for performing various functions such as diagnostics and communication, strategy code 284 supporting execution of the disclosed system and method, and various modules 282, 284 that may provide, among other things, timers, comparison functions, lookup tables, etc.

INDUSTRIAL APPLICABILITY

Figure 6:
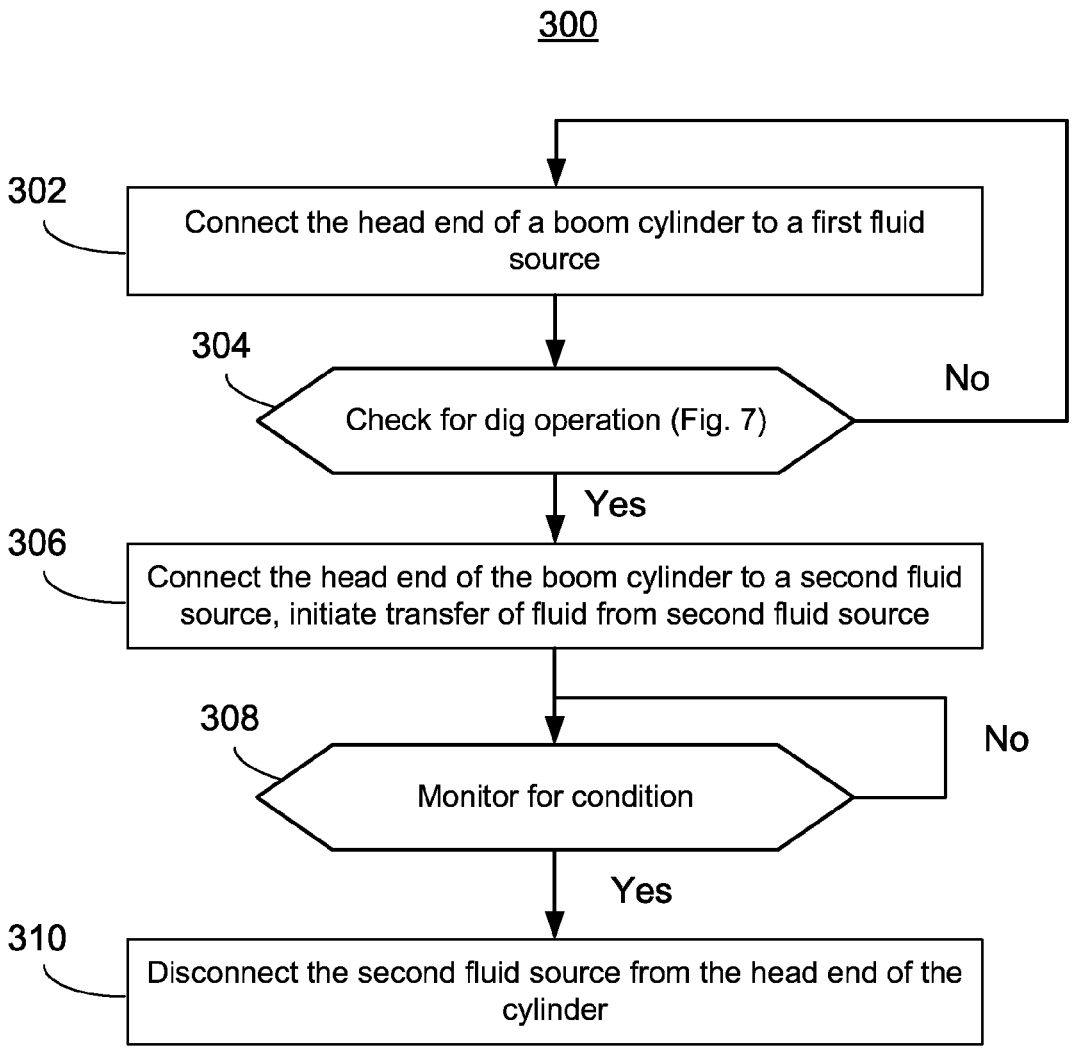
FIG. 6 is a flowchart of a method of reducing dig force in a hydraulic implement.

FIG. 6 is a flowchart of a method 300 of reducing dig force in a hydraulic implement 120. At a block 302 a head end 152 of a boom cylinder 108 may be connected to a first fluid source, such as a pump 132, via a valve 154. At block 304, a check may be made to determine if the hydraulic implement 120 is commencing a dig operation. More details about determining when a dig operation is beginning is discussed below with respect to FIG. 7. If a dig operation is beginning, the "yes" branch may be taken to block 306 where the head end 152 of the boom cylinder 108 may be connected to a second fluid source so that fluid is transferred from the second fluid source to the head end 152 of the boom cylinder 108. In one embodiment, the second fluid source may be a tank line 148 pressurized by a rod end 158 of the boom cylinder 108. In another embodiment, the second fluid source may be a pilot pressure source 188. In either case, a pressure of the second fluid source will be less than the pressure at the main pump because the main pump is active by definition during a dig operation.

After the second fluid source is connected to the head end 152 of the boom cylinder 108, at block 308, a controller 190 may monitor for one or more conditions. For example, a timer may be started after connecting the second fluid source that, in one embodiment, expires in a range of from 2 to 3 seconds. In another example, pressure at the head end 152 of the boom cylinder 108 may be monitored and the condition set when the head end pressure exceeds a threshold value, such as a pressure of the pilot pressure source 188. In other embodiments, another selected pressure below that of the main pump 132 may be designated. When the condition at block 308 is met, the "yes" branch from block 308 may be taken to block 310 where the second fluid source is disconnected from the head end 152 of the boom cylinder 108.

Returning to block 304, if no dig operation is detected execution may return to block 302 and the process repeated. In an embodiment, the loop repeats in a range of about every 8-12 ms. Other loop times may be supported based on a number of factors such as available processing capacity in the controller 190.

Returning to block 308, if none of the conditions are identified, execution may loop at block 308 until at least the timer has expired.

In the exemplary embodiments, the condition that ends the secondary fluid flow to the cylinder head end 158 may occur either at the expiration of a time period, such as two seconds, or when pressure at the head end 152 of the cylinder 108 reaches a level indicative of fluid from the main pump 132 arriving in sufficient volume to overcome any voiding.

Figure 7:
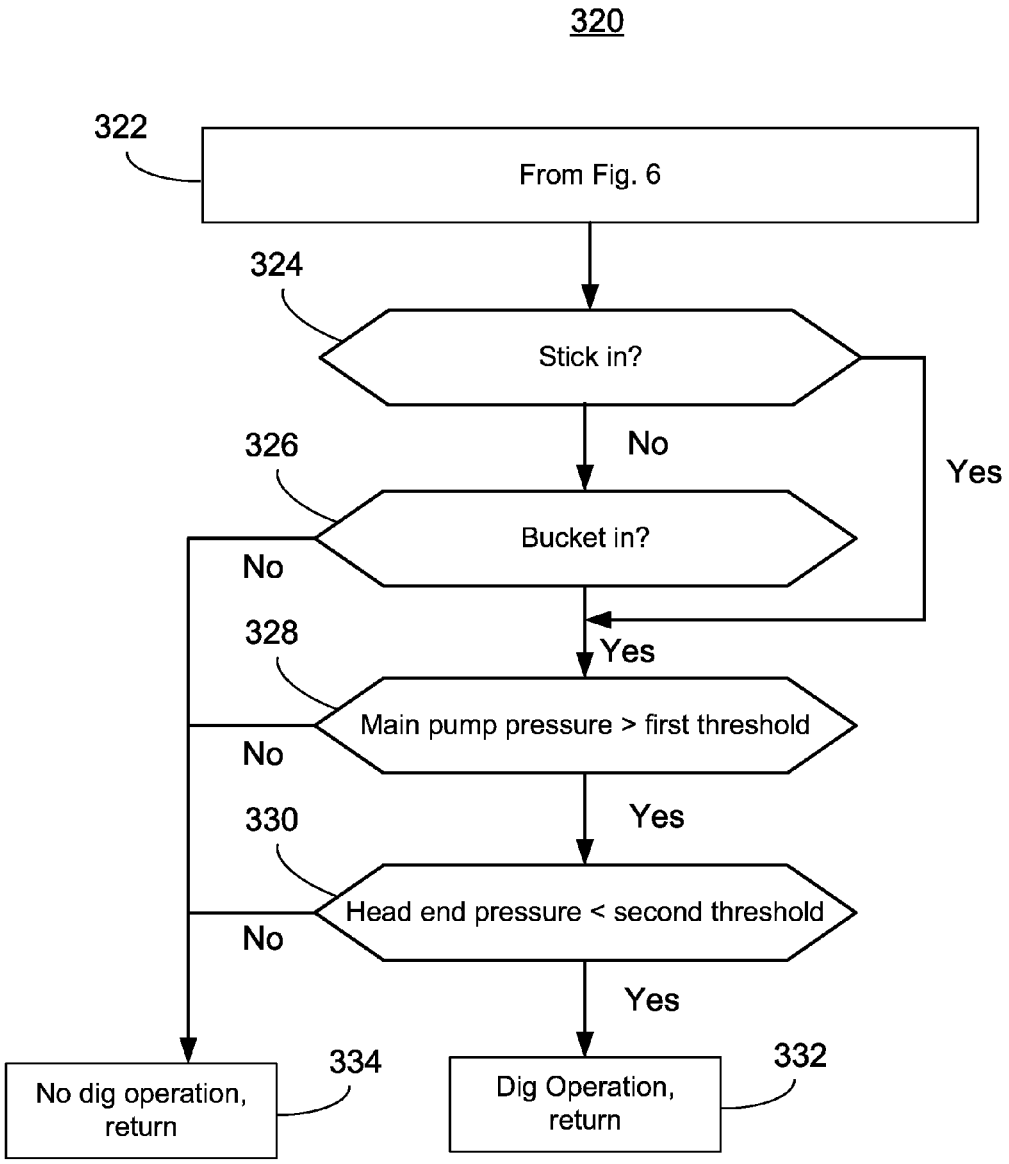
FIG. 7 is a flowchart amplifying the method illustrated in FIG. 6.

FIG. 7 is a flowchart amplifying the method 300 illustrated in FIG. 6. A method 320 may be used to determine when a dig operation is beginning. At block 322, execution may begin from block 302 of FIG. 6. At block 324 and 326 an evaluation been may be made to determine if either the stick 110 or the bucket 114 is being drawn in, that is, toward the excavator 102, indicative of a dig operation.

If either or both of these conditions exists, execution may continue at block 328 and a determination may be made if the pressure at the main pump 132, that is, a first fluid source, is above a first threshold pressure. This indicates that an operation is underway and the main pump 132 is active. In an embodiment the first threshold pressure may be a range of 8000-12,000 Kpa and typically may be in a range of 9000-11,000 Kpa.

If so, execution may continue at block 330, and a determination may be made if pressure at the head end 152 of the boom cylinder 108 is below a second threshold, indicating that the boom cylinder rod 160 is being drawn out, causing low pressure at the head end 152. In an embodiment, the second threshold may be in a range of 800-1200 Kpa and any pressure less than the second threshold may meet the criteria. In an embodiment, the pressure may be zero.

If the condition at block 330 is met the "yes" branch may be taken to block 332 where, for example, a flag may be set indicating a dig operation is commencing and execution returned to block 304 of FIG. 6. If at block 326, 328, or 330 the tested-for condition does not exist, execution may immediately fall to block 334, the flag indicating a dig operation may be cleared if needed and operation may be returned to block 304 of FIG. 6. The method 300 disclosed in FIG. 6 and FIG. 7 is but one example of how such a routine may be implemented but other embodiments are possible given this disclosure of what conditions are relevant to the operation.

The system and method disclosed above, in its various embodiments, is particularly applicable to excavators, such as excavator 102, but may also be used in other applications where hydraulic fluid voiding or cavitation occurs due to stresses on a hydraulic cylinder. The embodiments discussed above benefit operators of heavy hydraulic equipment, such as excavators, by offering a significant, measurable, fuel savings over prior art systems through the reduction of friction during the critical initial moments of a dig operation. Because no changes are required to the original boom cylinder spool valves 150 these savings can be realized in existing equipment with minimal new gear and/or modifications to hydraulic lines and existing controller strategies.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A method of providing fluid to a cylinder in an implement when the cylinder experiences low pressure, the method comprising:

delivering fluid to a head end of the cylinder from both a first fluid source and a second fluid source, the first fluid source providing fluid at a first pressure higher than a second pressure from the second fluid source;

identifying a condition that occurs while delivering fluid to the head end of the cylinder from both the first and second fluid sources, the condition being indicative of a pressure at the head end of the cylinder exceeding the second pressure;

responsive to identifying the condition, sending a signal to a valve causing the second fluid source to be disconnected from the head end of the cylinder.

2. The method of claim 1, further comprising configuring a secondary spool responsive to a command to connect a cylinder-to-tank line to the head end of the cylinder.

3. The method of claim 2, wherein configuring the secondary spool comprises using an electrically controlled valve to open the secondary spool responsive to the command.

4. The method of claim 1, wherein delivering fluid from the second fluid source comprises providing fluid from a pilot pressure source.

5. The method of claim 4, wherein delivering fluid from the second fluid source comprises opening an on/off valve responsive to identifying the beginning of a dig operation, the on/off valve connected between the pilot pressure source and the head end of the cylinder.

6. The method of claim 5, further comprising:

activating a timer responsive to opening the on/off valve, wherein the condition is an expiration of the timer.

7. The method of claim 5, further comprising:

monitoring a cylinder head end pressure, wherein the condition is the cylinder head end pressure reaching a predetermined value.

8. The method of claim 7, wherein the predetermined value is a specified pressure relative to a pressure of the pilot pressure source.

9. The method of claim 1, wherein the cylinder is a boom cylinder in an excavator and the method further comprises identifying a beginning of a dig operation.

10. The method of claim 9, wherein determining the beginning of the dig operation comprises:

determining that an engine speed is above low idle;

determining that no track command is active;

determining that the second pressure is a high pressure relative to an idle state; and the monitoring for a drop in pressure at the head end of the cylinder below a threshold pressure.

11. A method of reducing a void in a head end of a cylinder of a boom of an excavator comprising:

responsive to an increase in pressure at a rod-end of a boom cylinder associated with the beginning of a dig operation, connecting the head end of the boom cylinder to a first fluid source at a first pressure to initiate a transfer of fluid from the first fluid source to the head end of the cylinder;

connecting the head end of the cylinder to a second fluid source at a second pressure to initiate a transfer of fluid from the second fluid source to the head end of the cylinder, the first pressure higher than the second pressure;

after connecting the head end of the cylinder to both the first fluid source and the second fluid source, identifying a condition indicative of a pressure at the head end of the boom cylinder exceeding the second pressure; and disconnecting the second fluid source from the head end of the cylinder responsive to identifying the condition.

12. The method of claim 11, further comprising restricting flow from the first fluid source to the head end of the boom cylinder during an initial boom up command from an operator.

13. The method of claim 11, wherein determining that the dig operation is underway comprises:

identifying at least one of a stick in command and a bucket close command;

determining that a pilot pressure is above a first threshold value;

determining that a head end pressure of the boom is less than a second threshold value, the first threshold value greater than the second threshold value.

14. The method of claim 13, wherein determining that the dig operation is underway comprises determining at an electronics module of the excavator that the dig operation is underway.

15. The method of claim 11, wherein the identifying the condition comprises exceeding a predetermined time period measured from connecting the head end of the cylinder to the second fluid source.

16. The method of claim 15, wherein the predetermined time period is about 2 seconds.

17. An apparatus for providing fluid to a cylinder in an implement comprising:

a first fluid source that provides fluid at a first pressure;

the cylinder having a head end, the head end controllably coupled to the first fluid source via a spool valve;

a head end pressure sensor;

a control stick position sensor;

a second fluid source having a lower pressure than first pressure;

a control valve that operates responsive to an electrical signal to selectively connect the second fluid source to the head end; and a controller coupled to the head end pressure sensor, the control stick position sensor, and the control valve, wherein the controller generates the electrical signal to close the control valve to disconnect the second fluid source from the head end responsive to identification of a condition indicative of a pressure at the head end of the cylinder exceeding the lower pressure of the second fluid source.

18. The apparatus of claim 17, wherein the controller comprises a timer function that opens the control valve at a preset time following closing the control valve.

19. The apparatus of claim 17, wherein the controller opens the control valve responsive to a pressure at the head end reaching a threshold pressure value.

* * * * *